United States Patent [19]

Shaw

[11] 4,415,009

[45] Nov. 15, 1983

[54] WEFT INSERTING DEVICE FOR PNEUMATIC WEAVING LOOMS

[75] Inventor: Henry A. Shaw, Ieper, Belgium

[73] Assignee: N. V. Weefautomaten Picanol, Belgium

[21] Appl. No.: 311,643

[22] Filed: Oct. 15, 1981

[30] Foreign Application Priority Data

Oct. 15, 1980 [BE] Belgium ..... 58806

[51] Int. Cl.[3] ..... D03D 47/29; D03D 47/34

[52] U.S. Cl. ..... 139/435; 139/452

[58] Field of Search ..... 139/435, 450, 452

[56] References Cited

U.S. PATENT DOCUMENTS 4,197,882 4/1980 Ohnishi ..... 139/435

4,285,285 8/1981 Chambers et al. ..... 139/452

FOREIGN PATENT DOCUMENTS

WO81/02591 9/1981 PCT Int'l Appl. ..... 139/435

*Primary Examiner*—Henry Jaudon

*Attorney, Agent, or Firm*—Bacon & Thomas

[57] ABSTRACT

Weft inserting device for pneumatic weaving looms, of the type comprising a yarn pulling off mechanism, an air jet nozzle next to an edge of the warp, and a clamp which is located between these two last named components, this clamp being cyclically controlled to clamp the yarn at the end of the insertion of the next weft yarn, characterized in that the mutual geometric positions of the yarn pulling off mechanism and of the clamp are selected in relation to the position of the jet nozzle so that the yarn completely leaves the clamp whilst the latter is open.

5 Claims, 4 Drawing Figures

Fig. 1
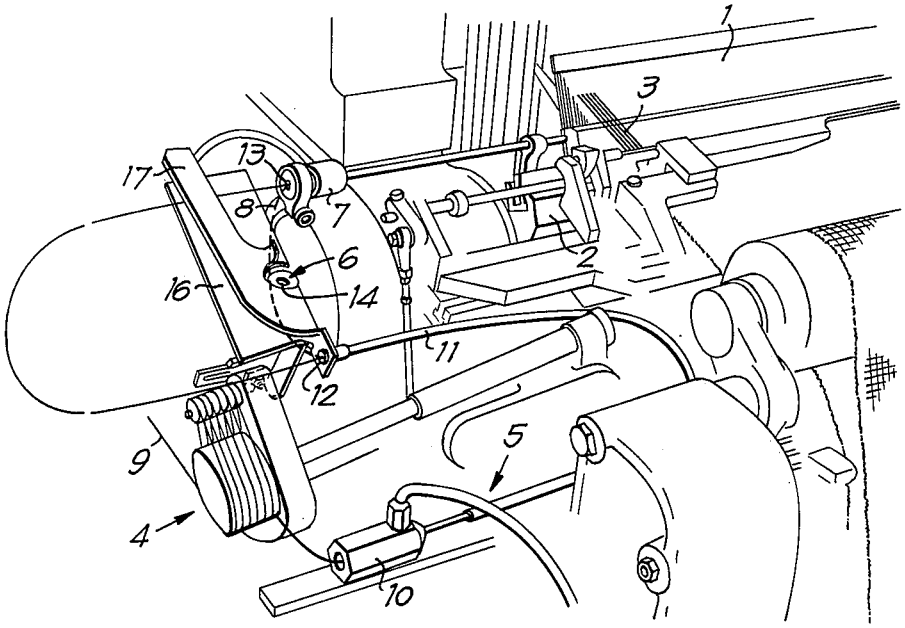
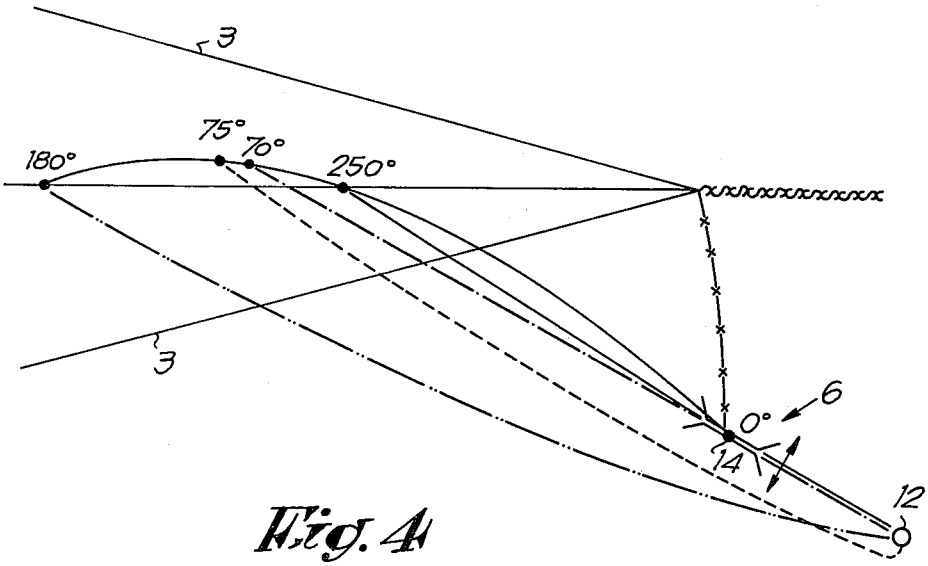
Fig. 4

WEFT INSERTING DEVICE FOR PNEUMATIC WEAVING LOOMS

The present invention relates to a weft inserting device for pneumatic weaving looms, of the type tht comprises a yarn pulling off device, an air jet nozzle located next to an edge of the warp, and a clamp located between the two latter components.

The clamp is being controlled in such a way that it remains open during the whole duration of the insertion of a weft yarn, after which is becomes closed until the beginning of a new cycle.

In all known pneumatic looms a suck like clamp is mounted in such a way that the yarn passes all the time through the clamp, where, of course, it is subject to friction. The latter have two drawbacks: on the one hand, they offer an extra resistance to the propagation of the weft yarn and, on the other hand, they cause a rapid soiling of the clamp. for the latter reason, blowing devices are provided on various looms to remove dust, fluffs and the like from the clamp. Through the present invention, there is obtained an effective yet simple solution of the problems sketched hereinabove.

This is achieved according to the invention through selecting the mutual geometric positions of the yarn pulling off mechanism and of the clamp in relation to the air jet nozzle in such a way that the yarn entirely leaves the clamp whilst the latter is open.

According to a preferred embodiment of the invention this leaving takes place as soon as the clamp is opened and lasts until shortly before the closing of the clamp.

In most pneumatic looms, the yarn pulling off mechanism is completed by a blowing device by means of which a store of yarn is built up between the aforesaid mechanism and clamp whenever the latter is closed. According to the invention, the force that is exerted by the blowing device on the yarn in the zone with the store is used to promote the speedy leaving from the clamp.

Figure 2:
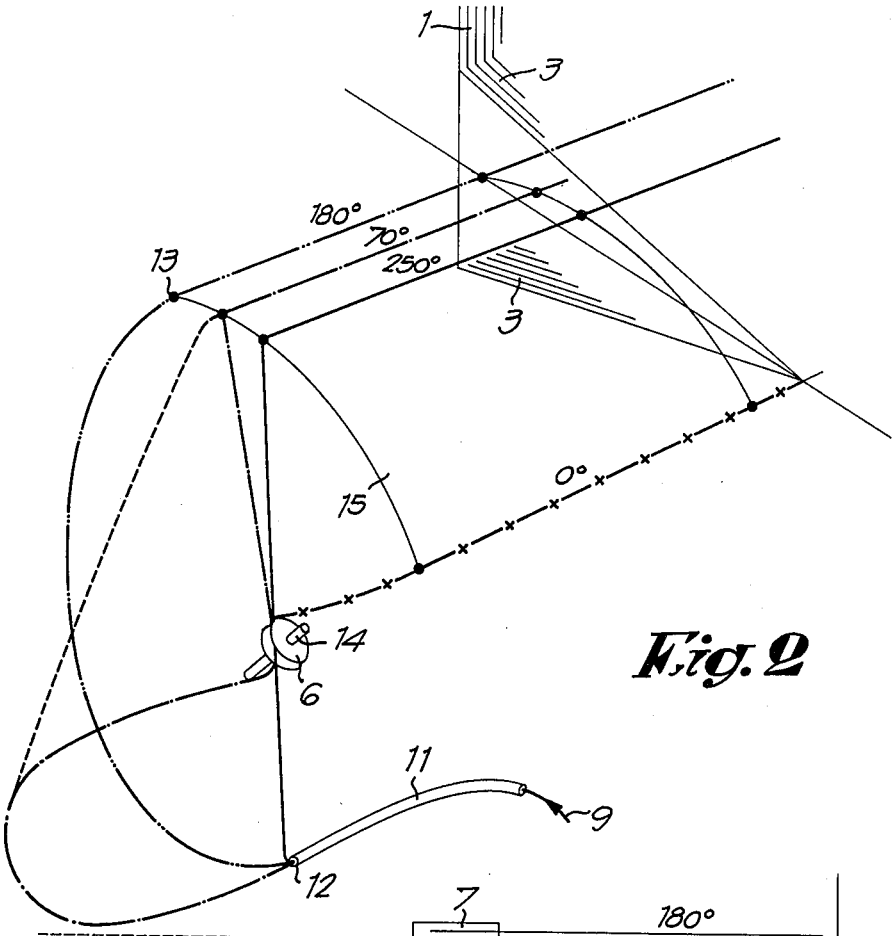
Figure 3:
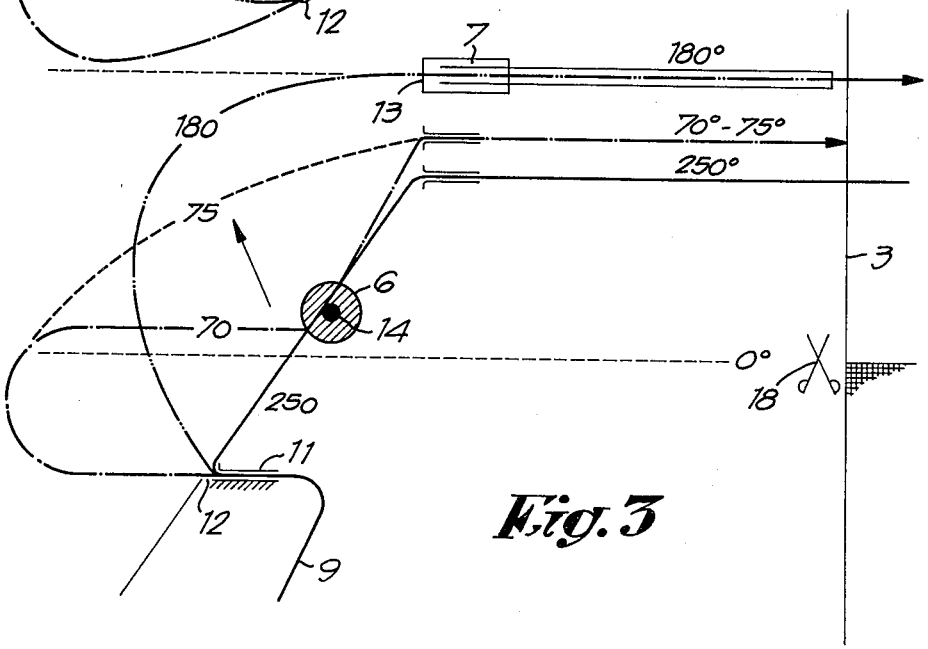

In order to throw more light on the foregoing, an example of an embodiment of the invention is more precisely, described, reference being made to the annexed drawings, in which:

FIG. 1 shows, in perspective, the part concerned by the invention of a pneumatic loom; and FIGS. 2 to 4 are sketches, respectively in perspective, bird's eye view and side-view, which elucidate the geometry of the device according to FIG. 1.

FIG. 1 shows the parts of a pneumatic loom which are to be taken into account here, that is to say: the reed 1 mounted on the lathe 2, and through which pass warp yarns 3; a yarn pulling off mechanism 4 with blowing device 5; a clamp 6 and an air jet nozzle 7 carried, on the one hand, by an oscillating lever 8 and, on the other hand, by the lathe 2.

The yarn pulling off mechanism 4 pulls off weft yarn 9 from a yarn spool or the like, which are not shown. At the same time the length of yarn which is required to form a weft is hereby measured.

The blowing device 5 consists of an air jet nozzle 10 with a curved outlet pipe 11 the free end of which is located in a plane which is parallel to the inlet 13 of the jet nozzle 7.

The clamp 6 is of a well known type and consists of two trays, one of which is mounted in a fixed position, whilst the other one is axially movable in relation to the first one through the operation of a rod 14.

The sketches according to FIGS. 2 to 4 schematically show the various positions that are occupied by the weft yarn during a cycle of the loom as a result of the geometrical arrangement according to the invention.

As shown in FIG. 2, the axis of the jet nozzle 7 describes forward and backward the developable surface 15 during one revolution of the crankshaft of the loom.

The positions indicated by 0° and 180° are respecively corresponding to the forward and rear dead centre of the lathe 2.

In the present example, the insertion of the weft starts at 70° and ends at 250°.

During the preparation of the loom for weaving, care has been taken to ensure that a length of yarn 9 was present between the outlet 12 and clamp 6 and that the yarn extends farther within the jet nozzle 7. The aforsaid length of yarn forms a store and is blown so as to form a loop by the jet nozzle 10 (see fine dot-and-dash line one the sketches).

When the crankshaft reaches 70°, the jet nozzle 7 blows at full power, the clamp 6 opens and the pulling off device 4 is operated to supply the very length of yarn which is required to form a complete weft.

Due to the geometrical positions of the components 12, 13 and 14, the yarn jumps out of the clamp 6, being helped furthermore through the action of the jet nozzle 10 (position 75, FIGS. 3 and 4).

Through this jumping away, possible dust particles, fluffs and the like are thrown out of the clamp 6.

From 75° to a little before 250°, the weft yarn extends between the points 12 and 13, completely out of reach in relation to clamp 6, so that no frictions are possible between the yarn and clamp.

A little before 250°, the yarn has come again between the trays of the clamp 6, due to the slowing down of the yarn pulling off mechanism, the continued action of the jet nozzle 7 and, especially, the geometrical configuration of the points 12, 13 and 14. To take care of the fact that vibrations often occur in the yarn between the points 12 and 13, during the blowing in of the weft, the clamp 6 is preferably equipped with two divergent guide plates. respectively 16 and 17 (FIG. 1).

At 250°, the weft is inserted completely into the shed. Clamp 6 closes, the pulling off mechanism 4 is now stopped and the air supply to jet nozzle 7 becomes much reduced.

At 0°, the weft becomes completely fixed by the reed 1 and the yarn 9 becomes cut at the side edge by a known device 18. A new cycle can start now.

It is to be mentioned that in the introduction and in the claims there is spoken about the mutual geometrical position of jet nozzle, clamp and yarn pulling off mechanism. Definite points of these components are hereby referred to, as points 12, 13 and 14 in the example described hereinabove. If, for instace, yarn guides are provided, respectively before the inlet 13 of the jet nozzle 7 or behind the inlet 12 of the tube 11, these points of support for the yarn must be taken into consideration.

It goes without saying that a great number of variants of the invention are possible, dependent on the arrangement of the loom which is to be equipped.

What I claim is:

1. Weft inserting device for pneumatic weaving looms, of the type comprising a yarn pulling off mechanism, a first air jet nozzle next to an edge of he warp, and a clamp which is located between these two last named components, this clamp being cyclically controlled to clamp the yarn at the end of the insertion of a weft until the beginning of the insertion of the next weft, characterized in that the mutual geometrical positions of the yarn pulling off mechanism and of the clamp are selected in relation to the position of the first air jet nozzle so that the yarn completely leaves the clamp whilst the latter is open.

2. Weft inserting device according to claim 1, wherein the geometrical positions are selected so that the yarn leaves the clamp at the moment at which this is being opened and remains outside the clamp until shortly before the closing of the latter.

3. Weft inserting device according to claim 2, wherein yarn pulling off mechanism is equipped with a second air jet nozzle, by means of which a length of yarn is blown so as to form a loop, characterized in that the air current coming from the second air jet nozzle removes at once the yarn from the clamp as soon as it is opened.

4. Weft inserting device according to claim 1, further comprising divergent guide plates adjacent the aforesaid clamp, in order to guide the yarn into the clamp.

5. Weft inserting device according to claim 1, wherein the first air jet nozzle follows the motions of the lathe of the loom, characterized in that the distance between the clamp and the first air jet nozzle is greater at the beginning of the insertion of the weft than at the end thereof and becomes shortest when the lathe has attained its forward dead centre.

* * * * *